US005222732A

United States Patent [19]

Robey

[11] Patent Number: 5,222,732

[45] Date of Patent: Jun. 29, 1993

[54] TENNIS TEACHING DEVICE AND METHOD

[75] Inventor: David M. Robey, Alexandria, Va.

[73] Assignee: R. J. Lasker, Washington, D.C. ; a part interest

[21] Appl. No.: 766,383

[22] Filed: Sep. 27, 1991

Related U.S. Application Data

[62] Division of Ser. No. 588,211, Jul. 26, 1990, Pat. No. 5,056,785.

[51] Int. Cl.[5] ..... A63B 61/00

[52] U.S. Cl. ..... 273/29 A

[58] Field of Search ..... 273/29 A, 26 R, 26 A; 446/266, 248

[56] References Cited

U.S. PATENT DOCUMENTS

| | | | |
|---|---|---|---|
| 2,578,313 | 12/1951 | Moseley | 273/29 A |
| 3,039,228 | 6/1962 | Mazzadra | 446/266 |
| 3,167,881 | 2/1965 | Mazzadra | 446/266 |
| 3,729,861 | 5/1973 | Lemoine | 446/248 |
| 4,022,467 | 5/1977 | Reuss | 273/29 A |
| 4,417,730 | 11/1983 | Weiner | 273/29 A |
| 4,898,384 | 2/1990 | Beach | 273/29 A |

*Primary Examiner*—Theatrice Brown
*Attorney, Agent, or Firm*—R. J. Lasker

[57] ABSTRACT

A device for teaching correct tennis stroke while swinging a tennis racket to hit a tennis ball. The device is comprised of a frame having a pair of spaced apart, triangular shaped side members. An elongated shaft is extended between the side members and has each end attached to a respective side member. A wheel is rotatably mounted on the shaft between the side members and above a ground support surface. Each side member has a configuration to allow the frame to be suspended on a support and above the ground support surface whereby the wheel will be freely rotatable on the shaft when struck by a tennis racket. The wheel is then struck with a glancing blow of a tennis racket during follow-through of the swinging motion of a trainee.

8 Claims, 2 Drawing Sheets

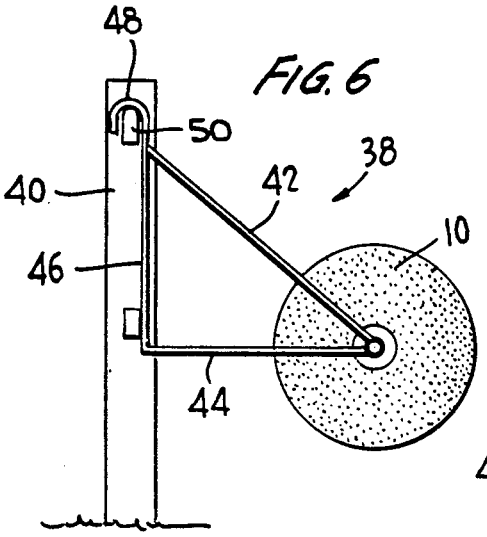
FIG. 6
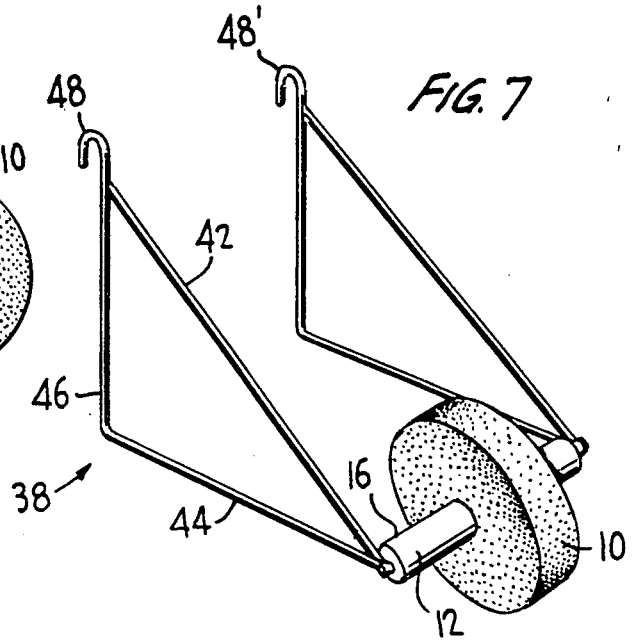
FIG. 7
FIG. 8
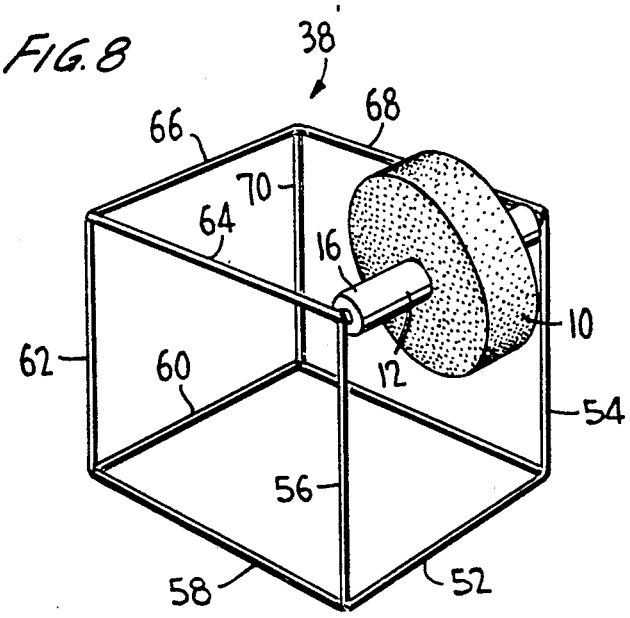

TENNIS TEACHING DEVICE AND METHOD

This application is a divisional application of application Ser. No. 588,211, filed Jul. 26, 1990, (U.S. Pat. No. 5,056,785).

BACKGROUND OF THE INVENTION

1. Field of the Invention

This invention relates to method and devices for teaching the hitting of tennis balls, and in particular the striking of the tennis ball to impart desired spins and slices thereto.

2. Related Art

U.S. Pat. No. 3,866,912 discloses a target structure mounted on an upright support shaft and a tennis ball simulating structure centrally mounted on the elongated target structure with deflector structures located at each end of the target structure on each opposite side of the tennis ball structure.

The tennis service instructional device of U.S. Pat. No. 3,940,132 reveals a tennis ball releasably held by suction at the mouth of a suspended supple hose at the proper height to be stroked by a tennis racquet such that the tennis ball is released from the restraining force of the suction upon impact by the tennis racquet.

The tennis stroke practice device of U.S. Pat. No. 3,948,517 uses a racquet target and a rotating ball mounted for rotation in a vertical plane upon being struck. A path defining means arrests the rotation of the ball except when it has been hit correctly.

U.S. Pat. No. 3,999,753 discloses a tennis ball dispensing device for practicing tennis strokes that includes an inclined tubular chute for retaining and delivering balls to a flexible sock having an opening therein permitting release of the tennis ball, the sock being suspended from a pivotal ring located at the lower end of the chute.

The tennis stroke practice device comprises a base plate with an upstanding tubular member positioned thereon to receive a z-shaped tube adjustably positioned therein and being comprised of telescoping members for adjusting the length thereof. One of the telescoping portions includes a ball positioned thereon such that the user can place a stringless tennis racquet thereover and practice his stroke by swinging the racquet throughout the length of the z-shaped tube.

U.S. Pat. No. 4,752,070 discloses a racket sport teaching aid device with a frame having a pointing member with a weight attached to the lower end of the frame. The weighted frame physically maintains the face of the racquet perpendicular to the plane of the ground at both the back swing and the ball impact point. The pointing member serves as a visual guide which points to the intended target point at completion of the stroke.

Finally, U.S. Pat. No. 4,519,608 reveals a tennis training device comprising a telescopic and orientable rod attachable to a wide belt in the dorsal region of the tennis player and bearing at its end an obstacle, the position of which is adjusted to define the place where the player's racquet is required to come to rest in the correct execution of a stroke of a definite type.

SUMMARY OF THE INVENTION

The teaching method and device of the present invention provides both positive and negative feedback when stroking the various spin shots in tennis, such as topspin, slice and spin serves.

The teaching device and method of the present invention enables the beginning and intermediate player to understand more accurately the concept behind imparting spin to a tennis ball.

The present invention allows a player of any skill level to practice and groove his tennis strokes.

The spinning device of the present invention can be used alone or with a partner.

The spinning device can be hand held, used on a platform or attached to a support such as a fence.

Because the beginning tennis player cannot stroke most tennis shots proficiently enough to impart the desired spin, hop or slice to the ball, there is great difficulty recognizing whether the ball has been stroked correctly or not. The teaching device and method of the present invention provides the tennis player with the necessary feedback to develop tennis shots, and particularly topspin, slice and spin shots, faster than would otherwise be the case.

Specifically the following tennis shots can be taught or practiced with the device and method of the present invention: topspin ground strokes, slice ground strokes, side spin ground stroke, drop shot, slice serve, twist serve and topspin lob. With respect to the teaching of the twist serve, the method and device of the present invention vividly show how to vary the angle and speed thereof.

In accordance with a preferred embodiment of the invention, the tennis teaching device comprises a circular wheel made of a soft, pliable material, such as polyurethane, mounted on a shaft rotatably attached to an intermediate shaft, which in turn is attached to a grip, such as that found on tennis racquets. The tennis teaching device is gripped by the tennis player and held in an appropriate position to practice serves or ground strokes by hitting the surface of the wheel with the strings of a tennis racquet, thereby causing the wheel to rotate in one direction or another in accordance with the location on the wheel that is struck by the tennis racquet, and, of course, the direction of motion of the tennis racquet relative to the wheel. By varying the direction of motion of the racquet relative to the wheel the tennis player can impart different spins or twists to the wheel causing it to rotate in one direction or the other. The rotation of the wheel provides a vivid demonstration of the different spin effects imparted to the wheel by striking it at different angles with the strings of a tennis racquet, which effects are similar to that imparted to a tennis ball when struck in the same manner as the wheel. Alternatively, the tennis device may be held by one tennis player or coach while being struck by another tennis player.

Alternatively, the wheel may be rotatably mounted in a frame which can be attached to a post, the fence surrounding a tennis court, or supported on the surface of the court by the frame itself.

The intermediate shaft is bent to facilitate holding of the teaching device by the tennis player in a position that is convenient to enable the wheel to be struck by a tennis racquet held in the other hand of the tennis player.

BRIEF DESCRIPTION OF THE DRAWINGS

The above objects, features and advantages of the invention are readily apparent from the following description of the best mode of carrying out the invention when taken in conjunction with the following drawings, wherein:

FIG. 6 is a side view of the tennis teaching device of the invention mounting on a post, thereby freeing both hands of the tennis player for practicing ground strokes;

FIG. 7 is a perspective view of the tennis teaching device of FIG. 6 of the invention; and FIG. 8 is a modified embodiment of a frame for supporting the tennis teaching device of the invention on the ground or the surface of the tennis court.

DETAILED DESCRIPTION

Figure 1:
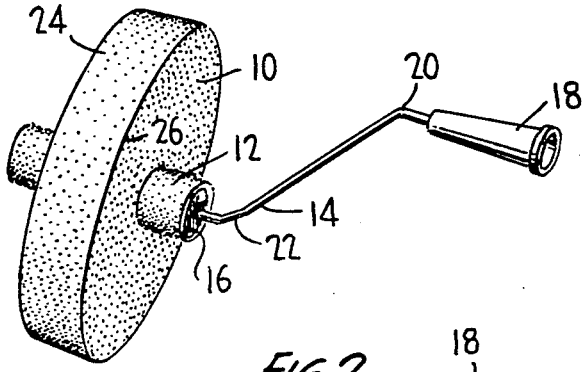
FIG. 1 is a perspective view of the tennis teaching device of the present invention showing the basic components thereof.

As shown in the perspective view of an embodiment of the tennis teaching device of the invention, in which wheel 10 is attached to shaft 12 which in turn is rotatable on fixed intermediate shaft 14 and fixed bearing 16 such that the aforementioned assembly of elements can be hand-held by a tennis player (not shown) by means of hand grip 18 as will be more fully explained hereinafter with respect to FIGS. 4 and 5. Shaft 14 is bent at portions 20 and 22 to enable the tennis teaching device to be conveniently held by a tennis player with one hand while striking wheel 10 with a tennis racquet in the other hand, thereby enabling both ground stokes and serves to be practiced. The angles of bending in intermediate shaft 14 are more fully described with respect to FIG. 3, infra.

Wheel 10 is preferably made of a soft, pliable but resilient substance such as polyurethane to resemble the surface of a tennis ball and to provide the necessary resilience to withstand constant and repetitious striking by the stings of a tennis racquet. Such a suitable substance would be, for example, a flexible foam type polyurethane compound. Other materials may be used, the criteria being that they have the characteristics set forth above.

Figure 2:
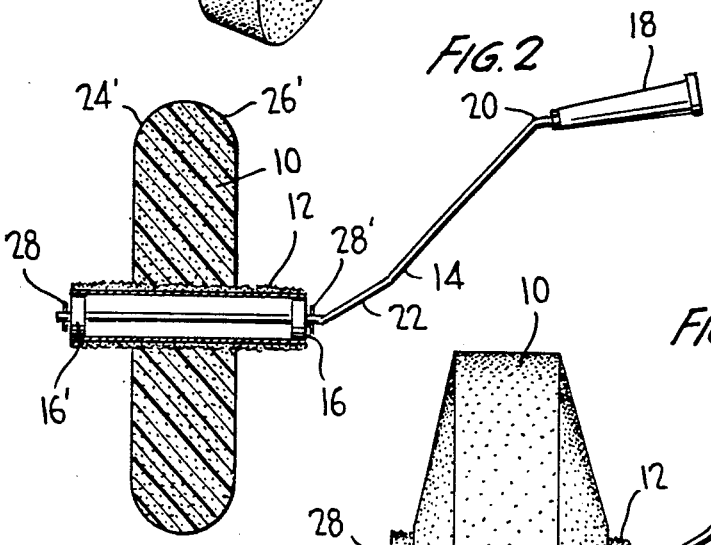
FIG. 2 is a side view partially in section showing the relationship between the fixed, shaft, rotatable shaft and rotating wheel of the tennis device of FIG. 1.

In the embodiment of FIG. 1 the corners 24, 26 of wheel 10 are illustrated as being sharp; however, corners 24, 26 may also be rounded, thereby presenting a surface more akin to that of a tennis ball as illustrated in FIG. 2 by rounded corners 24', 26'.

As shown in FIG. 2, bearings 16, 16' are rotatably mounted to intermediate shaft 14 and fixed to shaft 12 in spaced relation, and the assembly of wheel 10, shaft 12 and bearings 16, 16' is retained on intermediate shaft 14 by removable cotter pins 28, 28'. Wheel 10 is preferably force fit over shaft 12, thereby enabling its replacement in the event of normal wear or damage. Intermediate shaft 14 may be made of a lightweight material such as aluminum. In a prototype of the invention made by the inventor, shafts 12 and 14, bearings 16 and grip 18 comprised a paint roller assembly, and wheel 10 was cut from a pillow cushion. This proved to be an adequate teaching device which lasted for many months of tennis instruction and experimentation. It is therefore evident that the teaching device of the invention may be constructed of a wide range of materials, i.e., from the very crude to the sophisticated.

Figure 3A:
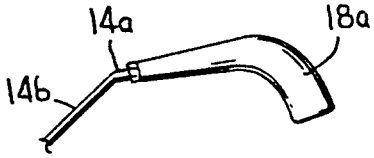
FIG. 3A is a detailed view of a modified grip of the teaching device in accordance with the invention.
Figure 3:
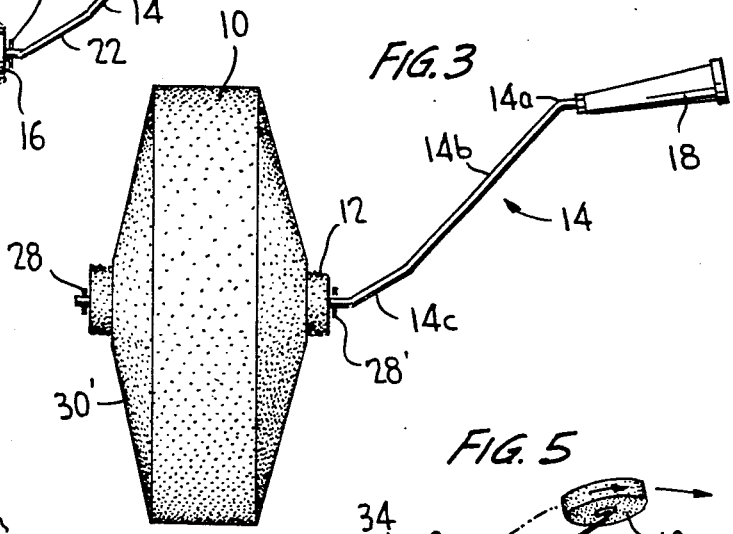
FIG. 3 is a perspective view of a modified embodiment of the teaching device of the invention.

The side view of a modified tennis device of the invention as shown in FIG. 3 is the same as that shown in FIG. 1 with the exception that wheel 10 is shaped to include a conical-shaped end portion 30, 30' on each respective side of wheel 10, thereby affording a more dynamically stable configuration with high speed rotation imparted to wheel 10 by being struck by the strings of a tennis racquet. In a preferred embodiment of the invention, portion **14*a* of intermediate shaft 14 is formed at an angle of approximately 150 degrees with the longitudinal axis of grip 18; portions 14*b* and 14*c* of intermediate shaft 14 are formed at an angle of 150 degrees with respect to one another; and portion 14*c* of intermediate shaft 14 is formed at an angle of 150 degrees with the longitudinal axis of shaft 12. These angles are not critical and may vary by five to ten degrees. The important criteria is that the resultant angle of the longitudinal axis of grip 18 with the longitudinal axis of shaft 12 be such that the teaching device can be held in one hand by a tennis player such that the wheel 10 may be conveniently struck by a tennis racquet held in the hand of the tennis player and enable both ground strokes and serves to be practiced as shown in FIGS. 4 and 5**.

Figure 4:
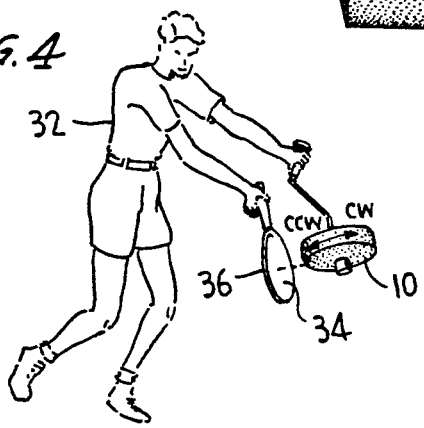
FIG. 4 illustrates use of the tennis teaching device being held by a tennis player in a position to practice ground strokes.
Figure 5:
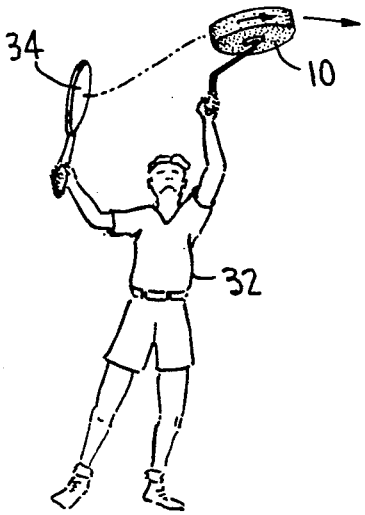
FIG. 5 shows use of the tennis teaching device by a tennis player in a position for practicing serves.

FIG. 3A is a detailed view of a modified grip or handle of the tennis teaching device showing a curved grip 18' which may be preferred to the straight grip 18 shown in both FIGS. 2 and 3 to more readily enable the tennis device to held in a more comfortable and accessible position in the hand of the tennis player to be used as shown in FIGS. 4 and 5.

FIG. 4 illustrates the use of the tennis teaching device of the invention for practicing ground strokes wherein a tennis player 32 is holding the tennis teaching device in the left hand and striking wheel 10 with the strings 34 of tennis racquet 36 to impart a rotation of wheel 10 in one direction or the other depending upon whether top spin or back spin is imparted to wheel 10. For example by striking wheel 10 with an upwardly directed stroke as is commonly employed when hitting a tennis ball to impart topspin thereto, wheel 10 will rotate CW as shown in FIG. 4. The application of back spin to a tennis ball is learned by the tennis play by hitting wheel 10 with a generally downwardly directed stoke thereby causing wheel 10 to rotate in a CCW direction as shown in FIG. 4. It is apparent that a tennis player can practice the aforementioned strokes at all different angles and heights by raising or lowering the tennis device and by moving it from side-to-side in relation to the body of the tennis player. Moreover, by turning the tennis device so that wheel 10 rotates substantially parallel to the ground, the tennis player 32 may practice side spin ground strokes.

Furthermore, top spin lobs may be practiced by holding the tennis device as shown and hitting wheel 10 with a more upwardly motion than that necessary to produce a top spin shot. Also, a drop shot may be practiced by undercutting wheel 10 with the strings 34 of tennis racquet 36 to cause a CCW rotation of wheel 10.

In FIG. 5 a tennis player 32 is shown practicing serves by holding the tennis device substantially as shown and striking wheel 10 with the strings 34 of tennis racquet 36. A top spin serve is practiced by striking wheel 10 to impart a CW rotation thereof. A twist serve is practiced by tilting wheel 10 at substantially a 45 degree angle and then striking it with the strings 34 of tennis racquet 36 in a manner similar to that of the top spin serve just described.

FIGS. 6 and 7 illustrate wheel 10 and shafts 12 and 14 of a modified tennis device suspended by frame 38 mounted to post 40 thereby relieving a tennis player from having to hold the tennis teaching device. Frame 38 merely consists of frame members 42, 44 and 46 formed in triangular shape as shown in FIG. 6 with frame member 46 including a hooked end portion 48 for engaging projection 50 of post 40. Projection 52 of the post engages the lower portion of frame member 46 to retain frame 38 in the position shown in FIG. 6. It is readily apparent that post 40 may be made adjustable in height such that the height of wheel 10 may be adjusted as desired by a tennis player. Alternatively, frame 38 may be suspended from the fence of a tennis court by hooked end portions 48, 48' at any height desired by the tennis player.

FIG. 10 shows a modified form of a frame 38' for supporting wheel 10 and shafts 12, 14 and bearing 16 on any desired portion of the ground or surface of, for example, a tennis court. Frame 38' is squarely or rectangularly-shaped and formed of frame members 52, 54, 56, 58; 60, 62, 64, 66 and 70 with wheel 10, shafts 12, 14 and bearings 16 of the tennis teaching device mounted between upright frame members 54, 56. It is evident that the height of frame members 54, 56 may be made adjustable thereby enabling the height of wheel 10 to be adjusted as desired by a tennis player.

Tennis players, and especially players just taking up or learning the game, have difficulty in learning the proper manner or technique of stroking the ball as such players tend to hit the ball "flat", whereas it is desired to put some spin on the ball. From the foregoing description of preferred embodiments of the invention it is evident that the tennis device enables a tennis player, and especially a beginning tennis player, to more readily learn the techniques involved in imparting various types of spin to a tennis ball. The rotation of the wheel as it is struck by the strings of a tennis racquet affords a vivid illustration of the proper manner to address a tennis ball to achieve similar spin thereof.

While various modifications and alterations can be made to the tennis teaching device described herein, the scope of the claims appended hereto is not intended to be limited by the explicit embodiments described herein, but such scope is intended to be determined by the equivalents to which the appended claims are entitled.

What is claimed is:

1. A device for teaching tennis strokes, comprising:

a frame;

a shaft adapted to be mounted within said frame;

a wheel rotatably mounted on said shaft about a spin axis;

a tennis racquet held by a hand of the user for stroking said wheel, said wheel thereby being induced to spin about said spin axis to simulate the effect of inducing spin on a tennis ball; and said frame is formed by a pair of triangularly-shaped members and said shaft extending between corresponding apices of said pair of triangularly-shaped members, and a corresponding leg of each triangularly-shaped member including means for suspending the frame from a support member, whereby said wheel is suspended from the ground at a height convenient for being struck by said tennis racquet.

2. A device as claimed in claim 1, wherein said wheel is made of flexible foam polyurethane.

3. A device as claimed in claim 1, wherein said wheel includes raised portions on each side thereof to stabilize the spinning of the wheel.

4. A device according to claim 1, wherein said wheel is removably mounted to said shaft.

5. A device according to claim 1, wherein said triangularly-shaped members each form identical right triangles and said apices are located at an intersection of the hypotenuse and another leg forming the right angle.

6. A device according to claim 1, wherein said support member is a pair of posts.

7. A device according to claim 1, wherein said support member is a fence.

8. A device according to claim 1, wherein said frame is defined as a three-dimensional rectangularly-shaped support member with upper and lower parallely-spaced support members, the latter support members being in contact with the ground and said shaft mounted between the respective end portions of said upper parallely-spaced support members so that said wheel is accessible for contact with said tennis racquet.

* * * * *